US008919011B2

(12) United States Patent
Byrne

(10) Patent No.: US 8,919,011 B2
(45) Date of Patent: Dec. 30, 2014

(54) FOOTWEAR WITH AIR CIRCULATION SYSTEM

(75) Inventor: Richard Byrne, Marlboro, MA (US)

(73) Assignee: C. & J. Clark International Limited (GB)

( * ) Notice: Subject to any disclaimer, the term of this patent is extended or adjusted under 35 U.S.C. 154(b) by 378 days.

(21) Appl. No.: 13/413,384

(22) Filed: Mar. 6, 2012

(65) Prior Publication Data

US 2012/0216432 A1 Aug. 30, 2012

Related U.S. Application Data

(60) Continuation-in-part of application No. 12/834,528, filed on Jul. 12, 2010, now Pat. No. 8,127,465, which is a division of application No. 11/565,309, filed on Nov. 30, 2006, now Pat. No. 7,793,426.

(51) Int. Cl.

| | |
|---|---|
| ***A43B 7/06*** | (2006.01) |
| ***A43B 9/02*** | (2006.01) |
| ***A43B 7/08*** | (2006.01) |

(52) U.S. Cl.

CPC . *A43B 7/081* (2013.01); *A43B 9/02* (2013.01); *A43B 7/085* (2013.01)

USPC ..... 36/3 R; 36/3 B

(58) Field of Classification Search

USPC ..... 36/3 R, 3 A, 3 B

See application file for complete search history.

(56) References Cited

U.S. PATENT DOCUMENTS

| | | | | |
|---|---|---|---|---|
| 1,211,542 | A * | 1/1917 | Carolin | 36/3 A |
| 1,335,273 | A | 3/1920 | Bruce | |
| 1,938,393 | A | 12/1933 | Kelly | |
| 2,050,337 | A | 8/1936 | Kelly | |
| 2,098,412 | A | 11/1937 | Bovay | |
| 2,239,211 | A | 4/1941 | Wylie | |
| 2,869,253 | A | 1/1959 | Sachs | |
| 3,012,342 | A | 12/1961 | Ramirez | |
| 3,128,566 | A | 4/1964 | Burlison et al. | |
| 3,331,146 | A | 7/1967 | Karras | |
| 4,693,021 | A * | 9/1987 | Mazzarolo | 36/131 |
| 4,776,110 | A | 10/1988 | Shiang | |
| 5,086,572 | A | 2/1992 | Lee | |
| 5,138,775 | A | 8/1992 | Chu | |
| 5,220,791 | A * | 6/1993 | Bulzomi | 36/3 R |
| 5,353,525 | A | 10/1994 | Grim | |

(Continued)

FOREIGN PATENT DOCUMENTS

| | | |
|---|---|---|
| DE | 9016134 U1 | 2/1991 |
| DE | 20111608 U1 | 9/2001 |

(Continued)

OTHER PUBLICATIONS

European Search Report Application No. EP 13 15 3795 Completed: Jun. 26, 2013; Mailing Date: Jul. 5, 2013 9 pages.

*Primary Examiner* — Marie Bays

(74) *Attorney, Agent, or Firm* — St. Onge Steward Johnston & Reens LLC

(57) ABSTRACT

A shoe with an air circulation system has a porous ventilated upper and a compressible pumping chamber in the heel which pumps cooling ambient air from an external air intake into a three dimensional mesh air distribution pad and out through the porous ventilated upper, providing cooling and reducing moisture in the cavity containing the wearer's foot.

12 Claims, 8 Drawing Sheets

(56) References Cited

U.S. PATENT DOCUMENTS

| | | | | |
|---|---|---|---|---|
| 5,400,526 | A | 3/1995 | Sessa | |
| 5,408,760 | A | 4/1995 | Tse et al. | |
| 5,815,949 | A | 10/1998 | Sessa | |
| 5,826,349 | A | 10/1998 | Goss | |
| 5,893,219 | A | 4/1999 | Smith et al. | |
| 6,041,518 | A | 3/2000 | Polycarpe | |
| 6,076,282 | A | 6/2000 | Brue' | |
| 6,260,288 | B1 | 7/2001 | Barthelemy et al. | |
| 6,305,100 | B1 | 10/2001 | Komarnycky et al. | |
| 6,434,858 | B2 | 8/2002 | Pan | |
| 6,463,679 | B1 * | 10/2002 | Buttigieg | 36/3 B |
| 6,477,865 | B1 | 11/2002 | Matsumoto | |
| 6,630,414 | B1 | 10/2003 | Matsumoto | |
| 6,755,052 | B1 | 6/2004 | Sytz | |
| 6,948,260 | B2 | 9/2005 | Lin et al. | |
| 7,178,266 | B2 | 2/2007 | Deem et al. | |
| 7,254,903 | B2 * | 8/2007 | Cho et al. | 36/3 R |
| 7,331,121 | B2 * | 2/2008 | Lo | 36/3 R |
| 7,788,952 | B2 | 9/2010 | Morrison | |
| 7,793,426 | B2 * | 9/2010 | Byrne et al. | 36/3 R |
| 7,980,008 | B2 * | 7/2011 | Song | 36/103 |
| 8,127,465 | B2 * | 3/2012 | Byrne et al. | 36/3 R |
| 8,387,276 | B2 * | 3/2013 | Polegato Moretti | 36/3 B |
| 2002/0170203 | A1 | 11/2002 | Sanner | |
| 2003/0145488 | A1 | 8/2003 | Cardarelli | |
| 2003/0188451 | A1 * | 10/2003 | Wu | 36/3 B |
| 2004/0010939 | A1 * | 1/2004 | Liu et al. | 36/29 |
| 2004/0159012 | A1 | 8/2004 | Keidel et al. | |
| 2005/0178023 | A1 | 8/2005 | Hammonds | |
| 2005/0241180 | A1 | 11/2005 | Squadroni | |
| 2006/0032082 | A1 | 2/2006 | Lin | |
| 2006/0032083 | A1 | 2/2006 | Lim | |
| 2006/0143943 | A1 * | 7/2006 | Cho et al. | 36/3 B |
| 2006/0156575 | A1 * | 7/2006 | Lo | 36/3 B |
| 2007/0068037 | A1 * | 3/2007 | Ridinger | 36/3 B |
| 2007/0089319 | A1 * | 4/2007 | Liao et al. | 36/3 R |
| 2008/0127519 | A1 * | 6/2008 | Byrne et al. | 36/102 |
| 2008/0163517 | A1 * | 7/2008 | Chen | 36/3 B |
| 2008/0229623 | A1 | 9/2008 | Ferretti | |
| 2010/0275466 | A1 | 11/2010 | Byrne et al. | |
| 2011/0167679 | A1 * | 7/2011 | Graziani et al. | 36/3 R |

FOREIGN PATENT DOCUMENTS

| | | | |
|---|---|---|---|
| EP | 0350611 | A1 | 1/1990 |
| EP | 0479183 | A2 | 4/1992 |
| FR | 2905053 | A1 | 2/2008 |
| WO | 2007128671 | A1 | 11/2007 |
| WO | 2010115737 | A1 | 10/2010 |
| WO | 2011051320 | A1 | 5/2011 |

* cited by examiner

FOOTWEAR WITH AIR CIRCULATION SYSTEM

CROSS-REFERENCE TO RELATED APPLICATIONS

This application is a continuation-in-part of U.S. patent application Ser. No. 12/834,528, filed on Jul. 12, 2010 now U.S. Pat. No. 8,127,465, which is a division of U.S. patent application Ser. No. 11/565,309, filed on Nov. 30, 2006, now U.S. Pat. No. 7,793,426, issued Sep. 14, 2010. The content of all prior applications is incorporated herein by reference.

FIELD OF THE INVENTION

The present invention relates to the field of shoe and footwear constructions.

BACKGROUND OF THE INVENTION

Modern footwear is available in a myriad of materials and fabrications. Despite great advances in support, there has been relatively little development in thermal management of footwear. The foot generates heat while walking, running, or even at rest. As heat is generated by the foot, the shoe temperature begins to rise, and the foot begins to perspire. Excessive perspiration around the foot leads to foot and shoe odor among other problems.

Specifically, the heat and perspiration released by the foot causes several problems. A wet and warm shoe interior is uncomfortable for the user to wear. Further, the perspiration released by the foot contains sodium chloride and urea, which can stain or discolor the outer surface of the shoe, degrading the expressive value of the shoe to the wearer. Moreover, the perspiration and heat around the foot creates an ideal environment for fungi and bacteria to thrive. Fungi and bacteria consume dead skin cells, and produce waste that is the source of foot odor. Fungi and bacteria convert the amino acid methionine to methanethiol which has a sulfuric smell. As physical activity increases, foot perspiration, bacterial growth, and bacterial waste production all increase, causing odor to intensify. Finally, a warm and moist shoe provides an ideal environment for foot disease, such as Athlete's foot, to thrive.

One approach minimizing the problems stated above is to provide shoe ventilation to transfer heat and moisture away from the foot. The theory behind shoe ventilation is to reduce the interior temperature and humidity of the shoe by transferring heat and foot perspiration generated by the foot away from the interior of the shoe. Since perspiration decreases with decreasing temperature, a decrease in the interior temperature of the shoe decreases the rate of perspiration around the foot. Thus, the goal of shoe ventilation is to maintain an interior shoe temperature as close to the ambient air temperature as possible. By forcing ambient air around the foot and into the shoe cavity, heat and moisture generated by the foot is transferred away from the foot by the circulating air.

Systems have been proposed in the prior art for ventilating the area under the foot. These systems have been directed at systems in the sole of the shoe actuated by foot movement during walking or running to circulate air within the interior of the shoe. While these systems help transfer excess heat away from the bottom of the foot surface they are ineffective because they do not transfer heat away from the top, rear, and sides of the foot. This allows excessive heat and moisture to build up inside the shoe. It is possible to make a shoe upper out of mesh or another relatively breathable material, however, these constructions are only suitable for certain types of running shoes or water shoes, and are not appropriate for street shoe constructions or office wear.

SUMMARY OF THE INVENTION

Accordingly, it is an object of the present invention to provide a shoe with an air circulation system which cools the foot by incorporating an air circulation system for transferring heat from the interior of the shoe to the ambient atmosphere.

These and other objects of the present are invention are achieved in one embodiment by a shoe with an air circulation system has a porous ventilated upper and a compressible pumping chamber in the heel which pumps cooling ambient air from an external air intake into a three dimensional mesh air distribution pad and out through the porous ventilated upper, providing cooling and reducing moisture in the cavity containing the wearer's foot.

The invention and its particular features and advantages will become more apparent from the following detailed description considered with reference to the accompanying drawings.

DETAILED DESCRIPTION OF THE DRAWINGS

Figure 1:
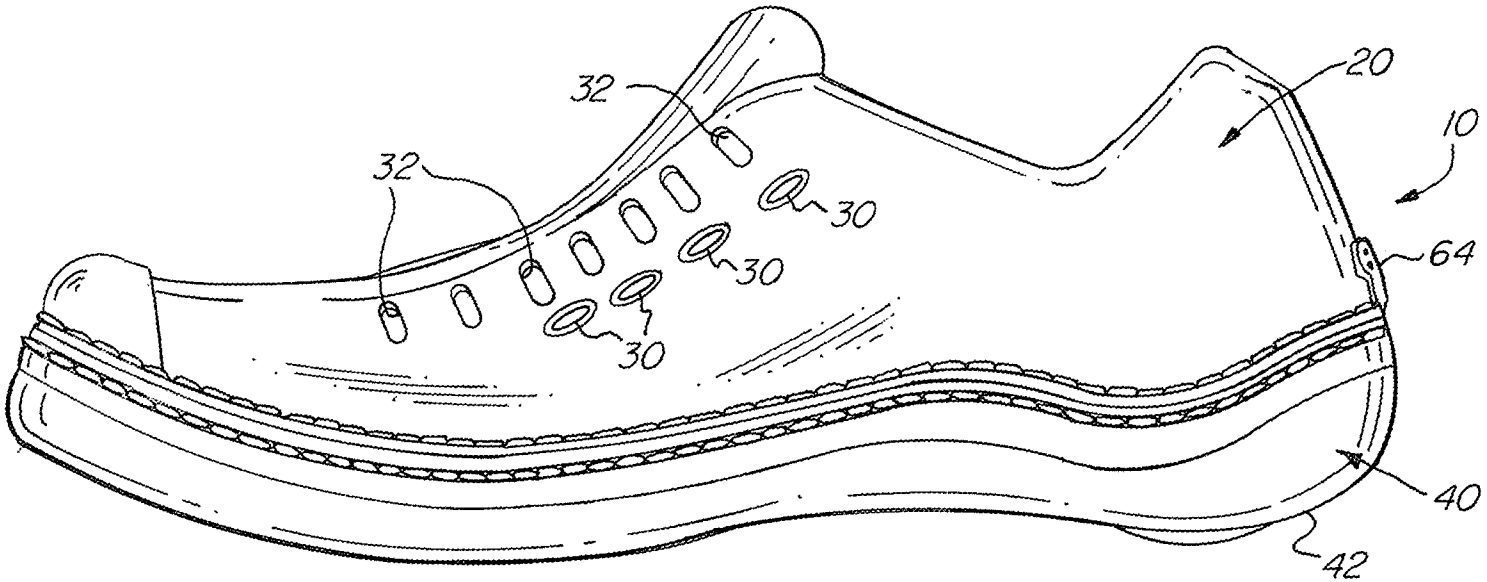
FIG. 1 is a left side elevation view of an embodiment of a shoe with an air circulation system in accordance with one embodiment of the invention.
Figure 2:
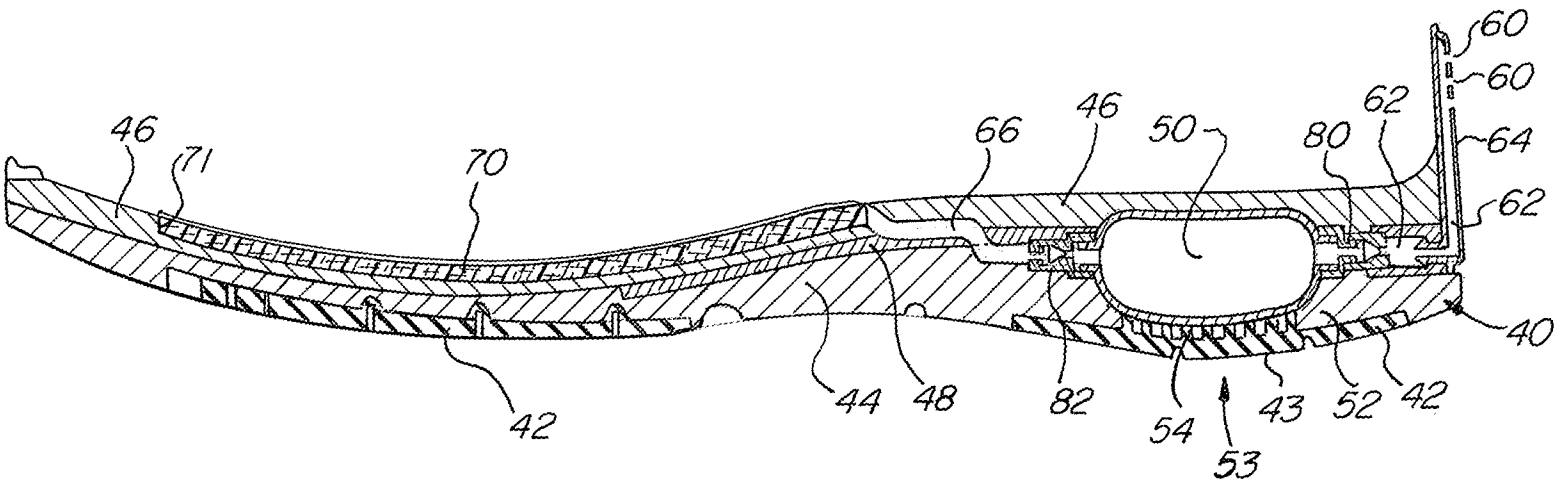
FIG. 2 is a left side cross sectional view of the sole a shoe with an air circulation system in accordance with one embodiment of the invention.
Figure 3:
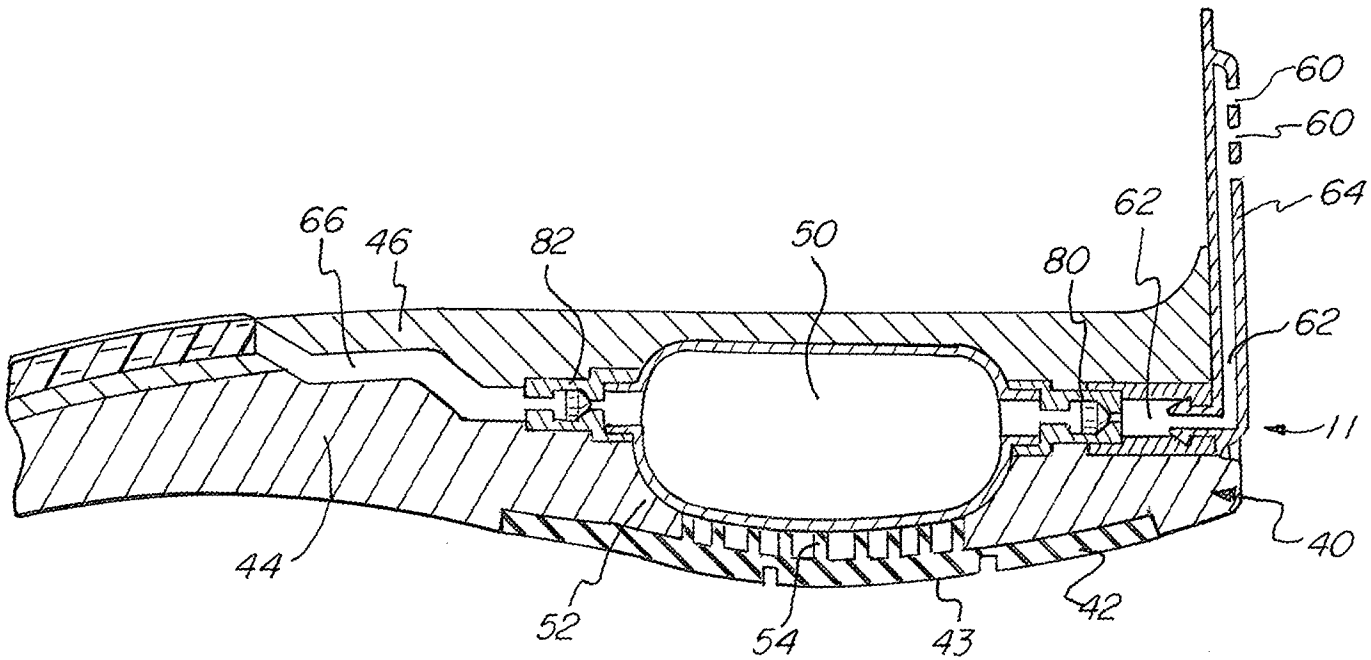
FIG. 3 is a detail cross sectional view of the heel area of the sole of the shoe with an air circulation system of FIG. 2.
Figure 4:
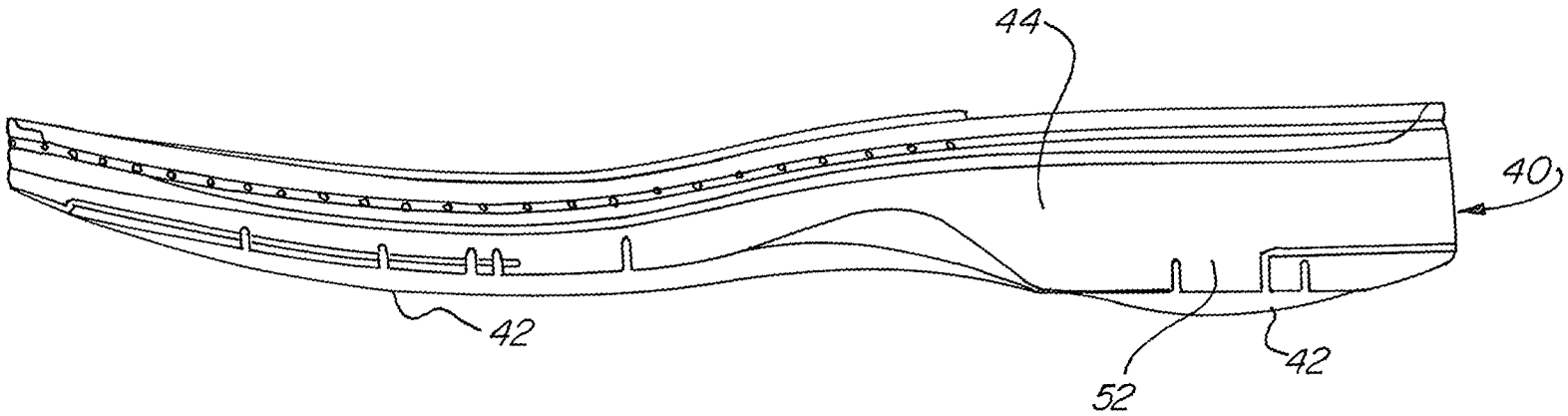
FIG. 4 is a left side elevation view of the sole of the shoe with an air circulation system of FIG. 2.

The disclosures of our prior U.S. Pat. Nos. 7,793,426 and 8,127,465 are hereby incorporated by reference. Also, we hereby incorporate by reference the disclosures of U.S. Pat. Nos. 5,893,219; and 5,826,349.

Referring to FIGS. 1-10, a shoe 10 with an air circulation system in accordance with the present invention is shown. The shoe with an air circulation system 10 includes an upper 20 and a sole 40. The upper 20 and the sole 40 are positioned together to form the shoe 10 with an air circulation system. The sole 40 and the upper 20 operate together to provide a ventilation system that circulates ambient air through the sole 40 and upper 20, cooling the interior cavity 12 of the shoe 10.

Figure 9:
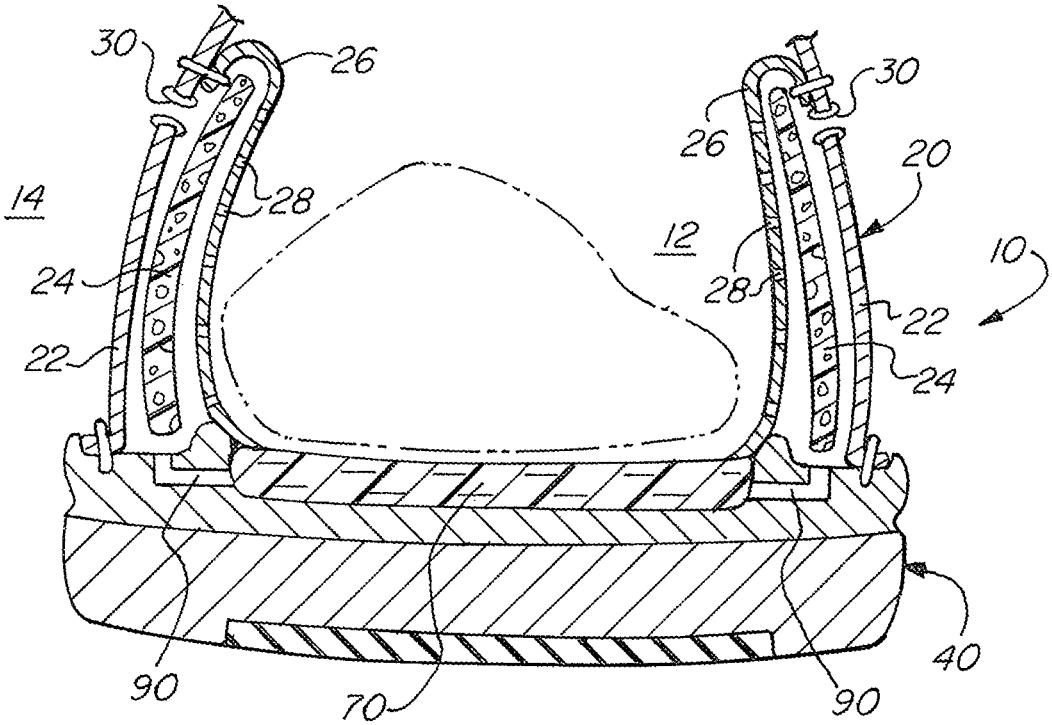
FIG. 9 is a cross-sectional view of a forefoot area of an embodiment of the shoe with an air circulation system.

Referring to FIGS. 1 and 9, the upper 20 includes an outer layer 22, a porous middle layer 24, and an inner layer 26. The inner layer 26 is adjacent to the interior cavity 12 of the shoe 10. The outer layer 22 is adjacent to the ambient atmosphere 14. The outer layer 22, porous middle layer 24, and inner layer 26 are positioned together to form a shoe upper 20. The layers 22, 24, 26 may be positioned together by any means known in the art, including stitching or gluing with an adhesive. It should be understood that the upper 20 may include a greater or lesser number of layers, and may include additional components, for example shoe laces.

Preferably the outer layer 22 is constructed from leather. However, the outer layer 22 may be constructed from canvas, synthetic leather, EVA, denim, wool, felt, or any other material or combination of materials known in the art. The porous middle layer 24 is constructed from a porous material through which air can pass with little or no resistance. Preferably the porous middle layer 24 is constructed from a synthetic mesh fabric material. However, the porous middle layer 24 may be constructed from any material or combination of materials through which air can pass with little or no resistance. Preferably the inner layer 26 is constructed from a soft lining.

The inner layer 26 is preferably provided with a plurality of perforations 28 to provide a fluid communication between the interior cavity 12 of shoe 10 and the porous middle layer 24 for venting the inside of the upper 10 to the middle layer 24. A uniformly applied plurality of small pinpoint perforations is preferable, however, any appropriate number and size of perforations 28 can be used.

The outer layer 22 is provided with one or more vent openings 30 for venting air out of the porous middle layer 24 to the atmosphere 14 outside of the upper 20. Desirably, vent openings 30 are in the form of a plastic eyelet having desirable design or appearance features. The upper may optionally include typical fastenings such as shoe lace holes 32 and shoe laces, or hook and loop fasteners, or buckles, or an elastic element.

In the embodiments shown in FIGS. 1 and 9, the upper 20 is positioned on the sole 40. Preferably the upper 20 is affixed to the sole 40. In the embodiment shown in FIGS. 1 and 9, the upper 20 is stitched directly to the sole 40. It is preferable that the upper 20 is attached directly to the sole 40 using a stitch. However, the upper 20 may be affixed to the sole 40 by an adhesive, fastener, or any other means known in the art.

Referring to FIGS. 1-10, the sole 40 includes an outsole 42, a midsole 44, and an insole 46. Preferably a thermoplastic shank 48 is provided in the center area of the shoe between the midsole 44 and insole 46.

Figure 5:
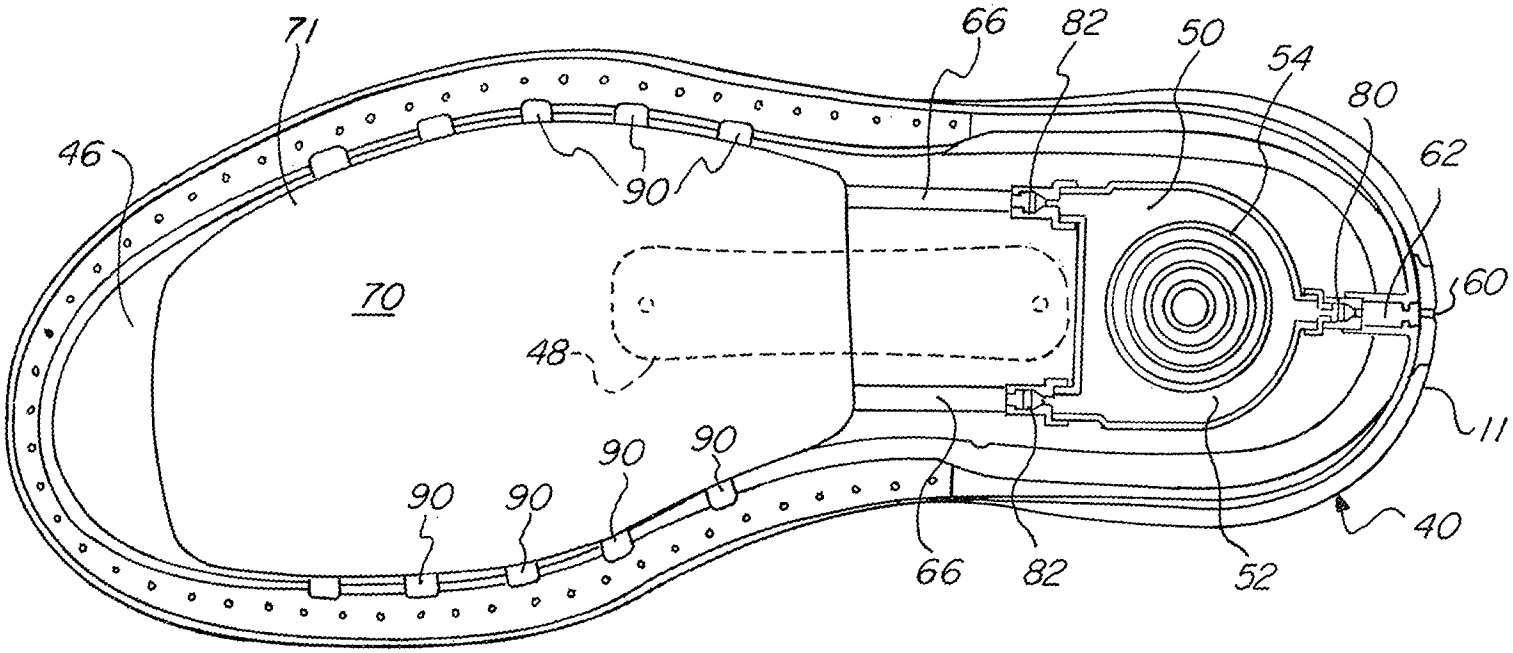
FIG. 5 is a top plan view of the sole of the shoe with an air circulation system of FIG. 2.
Figure 6:
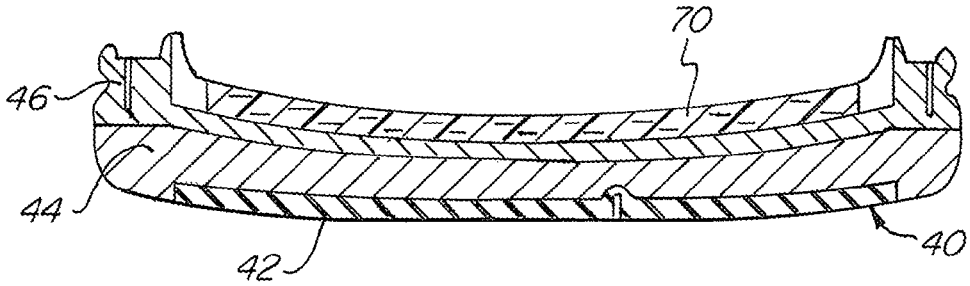
FIG. 6 is a cross-sectional view of a forefoot area of the sole of the shoe with an air circulation system of FIG. 2.

The air circulation system includes a compressible pumping chamber 50 located in a heel area 52 of the shoe between the insole 46 and the midsole 44. Pumping chamber 50 is a sealed chamber made from a resilient material. Desirably, the heel area 52 has a downwardly extending bump or bulge 53 which is comprised of a thin outsole 43 and thin, deformable portion 54 of the midsole 44, so that the pumping chamber 50 is periodically compressed by pressure applied thereto by a wearer walking in the shoe 10. This periodic compression pumps air through the air circulation system of shoe 10. The thin deformable midsole portion 54 is desirably formed as a series of concentric ribs or rings as best illustrated in FIG. 5, or it may be formed as another ribbed or perforated section to enhance the deformation of the portion 54 and the pumping of chamber 50.

Figure 10:
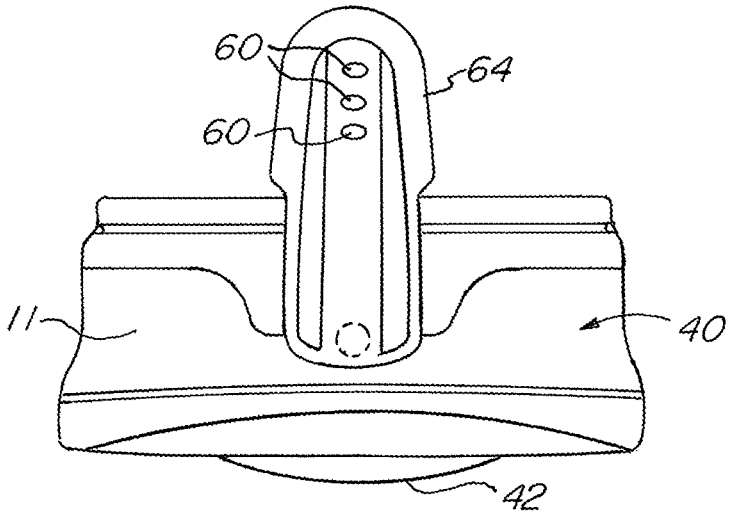
FIG. 10 is a rear elevation view of a snorkel of the shoe with an air circulation system.

Air is drawn into the air circulation system through an external air intake port 60 (which may include multiple port openings). An inlet fluid passageway 62 connects the external air intake port 60 to the pumping chamber 50. Preferably, the external air intake port 60 is located at a level above a level of the pumping chamber 50 and the inlet fluid passageway 62 includes an upwardly extending snorkel 64 as seen in FIG. 10. Snorkel 64 is preferably positioned at a rear end 11 of the shoe 10, however, in alternative embodiments, one or more snorkels and/or intake ports may be located on the sides of the shoe or at the front of the shoe.

One or more outlet fluid passageways 66 connect the pumping chamber 50 with an air distribution pad 70. Air distribution pad 70 is a three dimensional spacer mesh fabric and is located in a cavity 71 in the insole 46 in a forefoot area of the shoe. The upper surface of air distribution pad 70 is flush with the upper surface of insole 46. The three dimensional spacer mesh air distribution pad is preferably formed of a polyester material and provides both comfort underfoot and a breathable material that distributes circulated air under the wearer's foot. Examples of three dimensional spacer mesh fabrics that may be used in the invention include fabrics such as those disclosed in U.S. Pat. Nos. 5,385,036; 6,477,865; 6,630,414; 6,755,052; and 7,788,952, the disclosures of which are hereby incorporated by reference. The spacer mesh fabric should have a compression set which is generally comparable to the compression set of the foam material used in the insole 46, and should have a sufficient durability to maintain usability over the expected life of the shoe without a significant deviation in thickness compared to the surrounding insole 46.

In order to provide the desired pumping of air through the air circulation system, an inlet check valve 80 is located in the midsole 44 between the external air intake port 60 and the pumping chamber 50, and an outlet check valve 82 is located in each of the more outlet fluid passageways 66 between the pumping chamber 50 and the air distribution pad 70.

Figure 7:
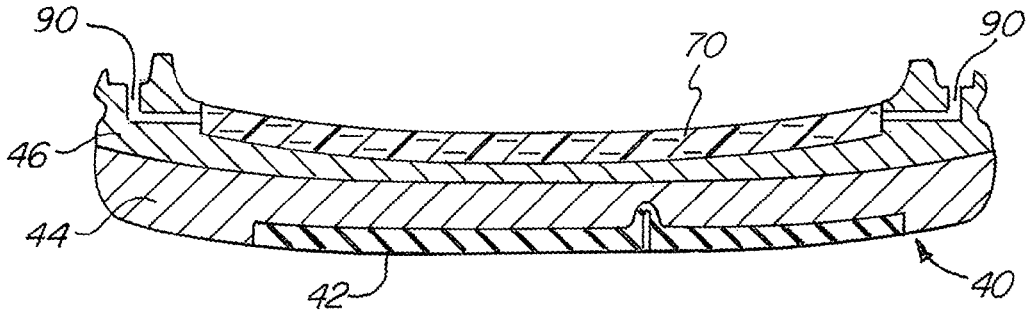
FIG. 7 is a cross-sectional view of a forefoot area of the sole of the shoe with an air circulation system of FIG. 2 having peripherally and upwardly extending channels in the midsole thereof.
Figure 8:
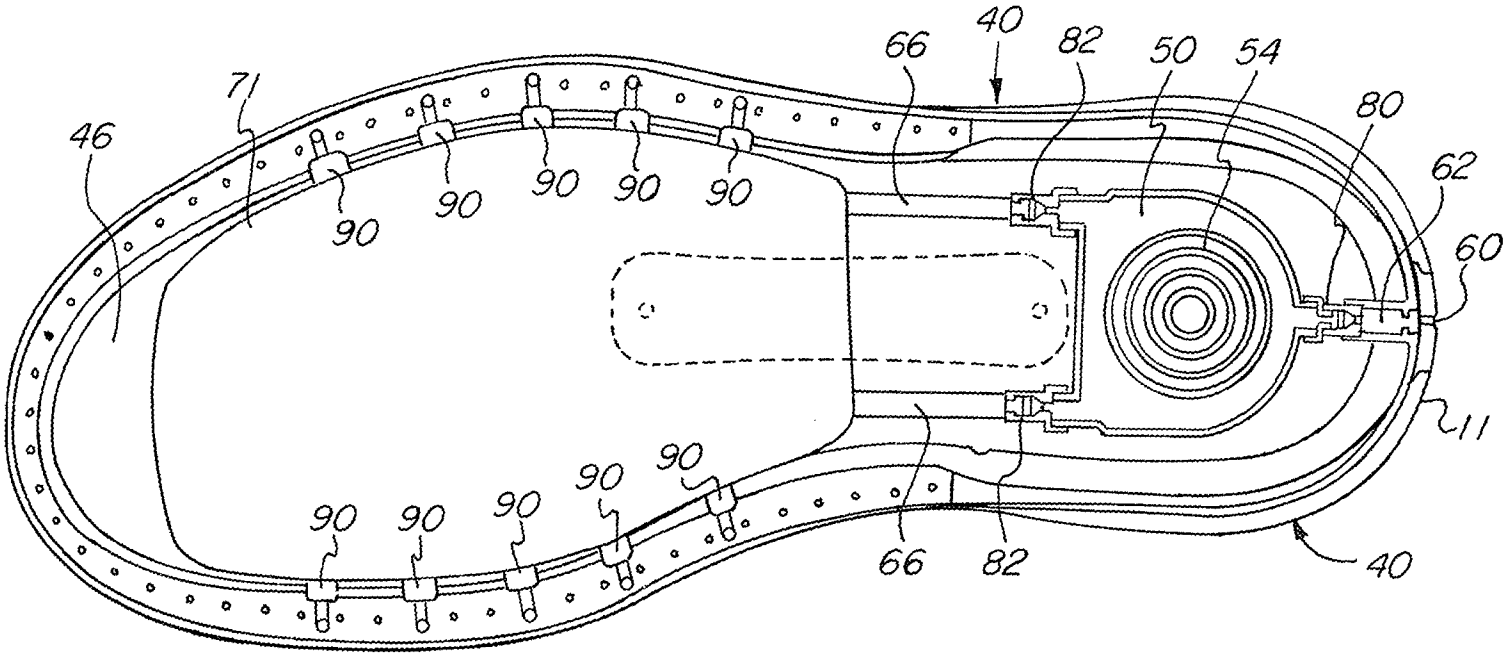
FIG. 8 is a top plan view of the sole of the shoe with an air circulation system of FIG. 2 having peripherally and upwardly extending channels in the midsole thereof.

As best seen in FIGS. 7 and 8, one or more peripherally and upwardly extending channels 90 are provided in the insole 46 and/or midsole 44 and extend from cavity 71 to provide fluid communication between the pumping chamber 50 and the porous middle layer 24 of the upper 20. In other embodiments, the peripherally and upwardly extending channels 90 may also or may alternately connect directly to the outlet fluid passageway 66 and extend through the insole and/or midsole and extend from cavity 71 to the perimeter thereof to provide fluid communication between the pumping chamber 50 and the porous middle layer 24 of the upper 20.

Pumping chamber 50 is being operable by periodic pressure applied thereto by a wearer walking in the shoe 10, which causes air to be drawn into the pumping chamber 50 from the external air intake port 60 through the inlet fluid passageway 62 and then expelled from the pumping chamber 50 through the outlet fluid passageway 68 to the air distribution pad 70, and from the upper 20 through the inner layer perforations 28 to the porous middle layer 24 of the upper 20 to the outer layer vent openings 30.

The present invention provides a shoe with an air circulation system which circulates cooling air underfoot and through a layer of the upper though the pumping action of the pumping chamber.

Although the invention has been described with reference to a particular arrangement of parts, features and the like, these are not intended to exhaust all possible arrangement or features, and indeed many other modifications and variations will be ascertainable to those of skill in the art.

What is claimed is:

1. A shoe with an air circulation system, comprising:

an upper having an outer layer, a porous middle layer formed of a porous material, and an inner layer, the inner layer having one or more inner layer openings for venting an inside of the upper to the middle layer, the outer layer having one or more vent openings for venting air out of the porous middle layer to outside of the upper;

a sole including an outsole, midsole, and an insole, and having:

an external air intake port, a compressible pumping chamber located in a heel area of the shoe, an inlet fluid passageway connecting the external air intake port and the pumping chamber, an inlet check valve between the pumping chamber and the external air intake port, an air distribution pad located within the shoe, an outlet fluid passageway connecting the chamber and the air distribution pad, an outlet check valve between the pumping chamber and the air distribution pad, one or more peripherally and upwardly extending channels provided in the insole or midsole to provide fluid communication between the pumping chamber and the porous middle layer of the upper, and the pumping chamber being operable by periodic pressure applied thereto by walking in the shoe by a wearer, which causes air to be drawn into the pumping chamber from the external air intake port through the inlet fluid passageway and expelled from the chamber through the outlet fluid passageway to the air distribution pad and from the upper through the porous middle layer of the upper to the outer layer vent openings.

2. The shoe with an air circulation system of claim 1, wherein the air distribution pad is a three dimensional mesh material.

3. The shoe with an air circulation system of claim 2, wherein the air distribution pad is a three dimensional polyester mesh fabric.

4. The shoe with an air circulation system of claim 1, wherein the external air intake port is located at a level above a level of the pumping chamber in an upwardly extending snorkel.

5. The shoe with an air circulation system of claim 4, wherein the snorkel is positioned at a rear end of the shoe.

6. A shoe with an air circulation system, comprising:

an upper having an outer layer, a porous middle layer formed of a porous material, and an inner layer, the inner layer having one or more perforations for venting an inside of the upper to the middle layer, the outer layer having one or more vent openings for venting air out of the porous middle layer to outside of the upper;

a sole including an outsole, midsole, and an insole, and having:

an external air intake port, a compressible pumping chamber located in a heel area of the shoe, an inlet fluid passageway connecting the external air intake port and the pumping chamber, an inlet check valve between the pumping chamber and the external air intake port, a three dimensional mesh air distribution pad located in a forefoot area of the shoe, an outlet fluid passageway connecting the chamber and the air distribution pad, an outlet check valve between the pumping chamber and the air distribution pad, one or more peripherally and upwardly extending channels provided in the insole or midsole to provide fluid communication between the pumping chamber and the porous middle layer of the upper, and the pumping chamber being operable by periodic pressure applied thereto by walking in the shoe by a wearer, which causes air to be drawn into the chamber from the external air intake port through the inlet fluid passageway and expelled from the pumping chamber through the outlet fluid passageway to the air distribution pad and from the upper through the inner layer perforations to the porous middle layer of the upper to the outer layer vent openings.

7. The shoe with an air circulation system of claim 6, wherein the air distribution pad is a three dimensional polyester mesh fabric.

8. The shoe with an air circulation system of claim 6, wherein the external air intake port is located at a level above a level of the pumping chamber in an upwardly extending snorkel.

9. The shoe with an air circulation system of claim 8, wherein the snorkel is positioned at a rear end of the shoe.

10. A shoe with an air circulation system, comprising:

an upper having an outer layer, a porous middle layer formed of a porous material, and an inner layer, the inner layer having one or more perforations for venting an inside of the upper to the middle layer, the outer layer having one or more vent openings for venting air out of the porous middle layer to outside of the upper;

a sole including an outsole, midsole, and an insole, and having:

an external air intake port, a compressible pumping chamber located in a heel area of the shoe, the external air intake port being located at a level above a level of the pumping chamber in an upwardly extending snorkel;

an inlet fluid passageway connecting the external air intake port and the pumping chamber, an inlet check valve between the pumping chamber and the external air intake port to permit air to flow into the pumping chamber from the external air intake port, a three dimensional spacer mesh air distribution pad located in a forefoot area of the shoe, an outlet fluid passageway connecting the chamber and the air distribution pad, an outlet check valve between the pumping chamber and the air distribution pad to permit air to flow out of the chamber into the air distribution pad, one or more peripherally and upwardly extending channels provided in the insole or midsole to provide fluid communication between the pumping chamber and the porous middle layer of the upper;

the pumping chamber being operable by periodic pressure applied thereto by walking in the shoe by a wearer, which causes air to be drawn into the chamber from the external air intake port through the inlet fluid passageway and expelled from the pumping chamber through the outlet fluid passageway to the air distribution pad and the porous middle layer of the upper, and from the upper through the inner layer perforations to the porous middle layer of the upper to the outer layer vent openings.

11. The shoe with an air circulation system of claim 10, wherein the air distribution pad is a three dimensional polyester mesh fabric.

12. The shoe with an air circulation system of claim 10, wherein the snorkel is positioned at a rear end of the shoe.

* * * * *